US009003565B1

(12) United States Patent
Leach

(10) Patent No.: US 9,003,565 B1
(45) Date of Patent: Apr. 14, 2015

(54) FASHION SCARF WITH HIDDEN NURSING COVER

(71) Applicant: Jamie S. Leach, Ada, OK (US)

(72) Inventor: Jamie S. Leach, Ada, OK (US)

( * ) Notice: Subject to any disclaimer, the term of this patent is extended or adjusted under 35 U.S.C. 154(b) by 192 days.

(21) Appl. No.: 13/766,806

(22) Filed: Feb. 14, 2013

(51) Int. Cl.
*A41D 1/20* (2006.01)
*A42B 5/00* (2006.01)

(52) U.S. Cl.
CPC ..... *A41D 1/205* (2013.01)

(58) Field of Classification Search
CPC ..... A41D 1/205
USPC ..... 2/104, 207, 202, 203, 131, 46, 48, 50, 2/51, 60, 106, 91, 88
See application file for complete search history.

(56) References Cited

U.S. PATENT DOCUMENTS

| | | | | |
|---|---|---|---|---|
| 891,166 | A | 6/1908 | Harrison | |
| 1,936,045 | A | 11/1933 | Bachrach | |
| 4,109,321 | A | 8/1978 | Shapiro | |
| 4,498,200 | A | 2/1985 | Livingstone | |
| 4,631,754 | A | 12/1986 | Ryan | |
| 4,712,251 | A * | 12/1987 | Cobble | 2/104 |
| 4,834,459 | A | 5/1989 | Leach | |
| 4,861,109 | A | 8/1989 | Leach | |
| D309,018 | S | 7/1990 | Leach | |
| 4,987,612 | A | 1/1991 | Middleton | |
| 5,103,514 | A | 4/1992 | Leach | |
| 5,325,818 | A | 7/1994 | Leach | |
| 5,592,692 | A | 1/1997 | Larson | |
| 5,960,471 | A * | 10/1999 | Burton | 2/48 |
| 6,016,573 | A | 1/2000 | Olson | |
| 6,301,713 | B1 * | 10/2001 | Aceves et al. | 2/104 |
| 6,343,727 | B1 | 2/2002 | Leach | |
| 6,427,251 | B1 | 8/2002 | Leach | |
| 6,499,164 | B1 | 12/2002 | Leach | |
| 6,553,590 | B1 | 4/2003 | Leach | |
| 6,601,252 | B1 | 8/2003 | Leach | |

(Continued)

FOREIGN PATENT DOCUMENTS

| | | | |
|---|---|---|---|
| JP | 2006169674 | A | 6/2006 |
| JP | 2006214025 | A | 8/2006 |
| KR | 20080001373 | U | 5/2008 |

OTHER PUBLICATIONS

Uncaged Lll, Screen shot of webpage at http://www.sholdit.com for Sholdit brand Clutch wrap, Uncaged LLC, Omaha, Nebraska, USA, shown in attached as Exhibit H to this Statement.

(Continued)

*Primary Examiner* — Gloria Hale
(74) *Attorney, Agent, or Firm* — Mary M. Lee

(57) ABSTRACT

A fashion neck scarf comprising a hidden compartment that holds a nursing panel. The scarf may be an endless ring, or so-called "infinity" scarf, or a long rectangle. The nursing panel is sized to cover the front of the person and at least the infant's head and shoulders while the infant is nursing. A proximal edge of the panel is fixed to the scarf inside the compartment, and the nursing panel is alternately positionable between a stowed positioned in which the panel is compacted inside the compartment and a deployed position in which the panel is unfurled. This scarf may be arranged in several different fashionable configurations when the nursing panel is not in use. When nursing the infant, the scarf can be arranged in different ways to maximize the user's comfort and to secure the panel in position and prevent it from being displaced inadvertently.

23 Claims, 6 Drawing Sheets

(56) References Cited

U.S. PATENT DOCUMENTS

| | | | | |
|---|---|---|---|---|
| 6,751,817 | B1 | 6/2004 | Leach | |
| 6,760,934 | B1 | 7/2004 | Leach | |
| 6,986,163 | B2 * | 1/2006 | Dugan | 2/69 |
| 7,010,821 | B1 | 3/2006 | Leach | |
| 7,114,206 | B2 | 10/2006 | Leach | |
| 7,207,070 | B1 * | 4/2007 | Swarez-Ballesteros | 2/104 |
| 7,353,552 | B2 | 4/2008 | Leach | |
| D571,596 | S | 6/2008 | Alvisture et al. | |
| 7,490,362 | B2 * | 2/2009 | Owen | 2/104 |
| 7,500,278 | B2 | 3/2009 | Leach | |
| 7,513,001 | B1 | 4/2009 | Leach | |
| D591,483 | S * | 5/2009 | Petti et al. | D2/823 |
| 7,555,790 | B2 * | 7/2009 | Ostrander | 2/104 |
| 7,562,406 | B1 | 7/2009 | Leach | |
| 7,640,600 | B2 | 1/2010 | Reder | |
| 7,676,871 | B1 | 3/2010 | Leach | |
| 7,708,342 | B2 | 5/2010 | Leach | |
| 7,793,371 | B1 | 9/2010 | Leach | |
| 7,878,587 | B1 | 2/2011 | Leach | |
| 7,926,135 | B1 | 4/2011 | Leach | |
| 8,020,217 | B2 | 9/2011 | Moore et al. | |
| 8,136,186 | B1 | 3/2012 | Leach | |
| 8,146,760 | B1 | 4/2012 | Leach | |
| 8,151,372 | B2 | 4/2012 | Densmore et al. | |
| 8,419,128 | B1 | 4/2013 | Leach | |
| 8,448,275 | B1 | 5/2013 | Leach | |
| 8,468,627 | B2 | 6/2013 | Leach | |
| 8,479,334 | B1 | 7/2013 | Leach | |
| 2005/0278864 | A1 | 12/2005 | Leach | |
| 2007/0022526 | A1 | 2/2007 | Leach | |
| 2007/0028384 | A1 | 2/2007 | Leach | |
| 2007/0046084 | A1 | 3/2007 | Leach | |
| 2007/0124845 | A1 * | 6/2007 | McCoy | 2/104 |
| 2007/0151031 | A1 | 7/2007 | Leach | |
| 2007/0277321 | A1 | 12/2007 | Leach | |
| 2008/0222768 | A1 | 9/2008 | Haarala et al. | |
| 2009/0260127 | A1 * | 10/2009 | Prezgar | 2/88 |
| 2010/0235963 | A1 | 9/2010 | Haydon | |
| 2010/0237121 | A1 | 9/2010 | Stein | |
| 2011/0138519 | A1 | 6/2011 | Serota | |
| 2011/0296581 | A1 * | 12/2011 | Armstrong | 2/104 |
| 2012/0284893 | A1 * | 11/2012 | Sohn | 2/46 |
| 2013/0152271 | A1 * | 6/2013 | Clark | 2/104 |

OTHER PUBLICATIONS

Bebe Au Lait, screen shot of webpage at http://babysteals.stealnetwork.com/archive, attached as Exhibit D to this Statement, was on sale prior to the filing date of this application.

The Leachco CUDDLE-U MOTHER COVER product, which is shown and described in the web page attached as Exhibit A to this Statement, was in public use and/or on sale at least as early as about Sep. 13, 2011.

The Leachco MOTHER COVER DUO product, which is shown and described in the web page attached as Exhibit B to this Statement, was in public use and/or on sale at least as early as about Nov. 26, 1997.

The Leachco COVERED 'N COOL product, which is shown and described in the web page attached as Exhibit C to this Statement, was in public use and/or on sale at least as early as about Dec. 1, 2000.

The Leachco CHILL 'N BIB product, which is shown and described in the catalog page attached as Exhibit E to this Statement, was in public use and/or on sale at least as early as about Oct. 00, 1997.

The Leachco COLIC COMFORTER product, which is shown and described in the instruction sheet and catalog page attached as Exhibit F to this Statement, was in public use and/or on sale at least as early as about 1993.

The Leachco KID KAPER product, which is shown and described in the instruction sheet attached as Exhibit G to this Statement, was in public use and/or on sale at least as early as about Feb. 26, 1990.

Uncaged LLL, "Sholdit" [online] webpage retrieved from http://sholdit.com, Uncaged LLC, Omaha, Nebraska, USA. The first publication date of this reference is unknown. This document was published prior to the effective filing date, namely, Feb. 14, 2013, and prior to any foreign priority date of the present application. [retrieved on Feb. 13, 2013].

* cited by examiner

FASHION SCARF WITH HIDDEN NURSING COVER

FIELD OF THE INVENTION

The present invention relates generally to fashion scarves and to nursing covers.

DETAILED DESCRIPTION OF THE PREFERRED EMBODIMENT(S)

Breast feeding is recommended by many in the health care industry to promote good health in the infant as well as emotional bonding between the infant and mother. Most mothers prefer privacy when breast feeding and cannot always be at home or in an equally private environment when the infant needs to nurse. In particular, an increasing number of employers are offering daycare at the workplace, which allows more working women to breast feed their babies at their workplace.

Many nursing covers are presently available and have afforded the needed privacy while nursing. However, most such covers are suited solely for nursing and must be carried or stowed with other baby supplies when traveling with the infant. The present invention combines the fashion of a neck scarf with the function of a nursing cover. Working mothers can make the scarf of this invention part of their professional dress, allowing them to breast feed privately without having to stow or carry a separate "uni-tasker" nursing cover. Because of these many advantages, its use is not limited to an accessory for breast feeding an infant; any caregiver bottle feeding an infant may wish to utilize this garment.

Figure 1:
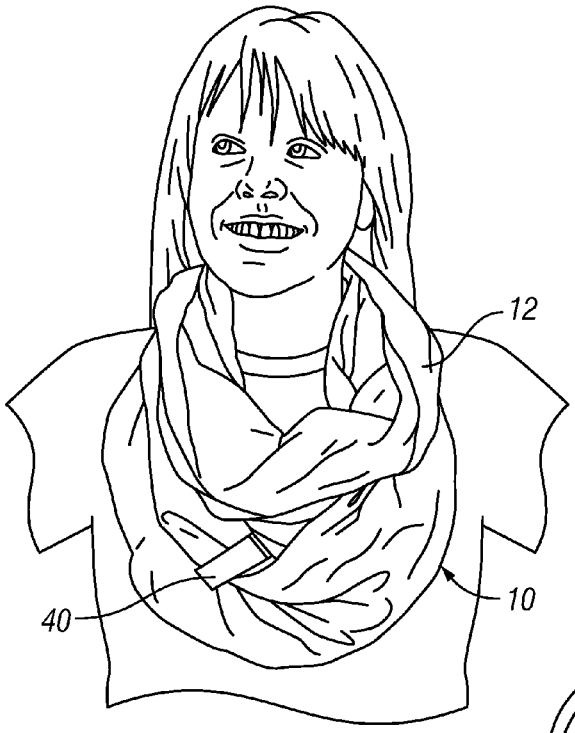
FIG. 1 is a frontal view of a woman wearing a scarf made in accordance with a first embodiment of the present invention in which the scarf is an endless ring of fabric. The "infinity" style scarf is shown in a double-looped configuration around the woman's neck.
Figure 2:
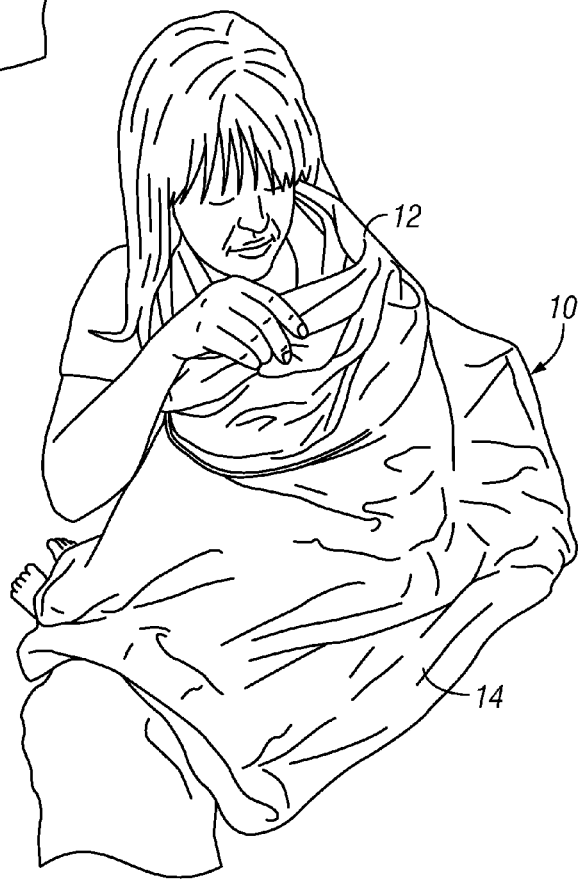
FIG. 2 is a frontal perspective view of the woman nursing an infant. The scarf is worn in a double-loop, and the nursing cover panel is deployed and draped over the baby.
Figure 3:
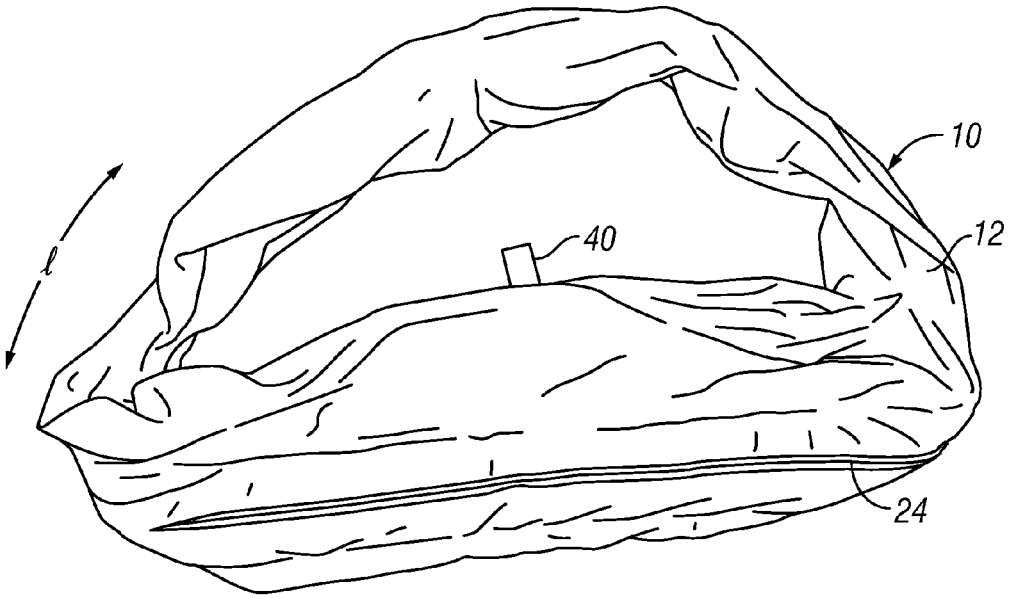
FIG. 3 is a perspective view of the scarf showing the zippered opening to the compartment that contains the nursing cover panel.

Turning now to the drawings in general to FIGS. 1 and 2 in particular, there is shown therein a breast feeding or nursing garment made in accordance with a first preferred embodiment of the present invention. The garment, designated generally by the reference numeral 10, comprises a ladies fashion neck scarf 12. Preferably, the scarf 12 is made of an attractive fabric, which may vary widely. It may take the form of an endless ring, popularly referred to as an "infinity" scarf, as shown in FIGS. 1-11. As shown in FIG. 1, the inventive scarf 12 can be worn in the popular double loop configuration when used as a fashion scarf. In this mode, the nursing panel 14 (FIG. 2) is in the stowed or non-deployed position and is hidden from view. However, as shown in FIG. 2, when the need arises, the nursing panel 14 can be deployed and without having to remove the scarf.

The preferred structure of the garment 10 will be explained in detail with reference to FIGS. 3-6. As indicated previously, the garment 10 comprises a fabric neck scarf 12. The scarf 12 is formed with an internal compartment 20. The compartment 20 may be made of the same or a different fabric. A preferred size for the compartment 20 is about 3-4 inches wide and about 26-30 inches long. The depth of the compartment may be slightly less than the width "w" (FIG. 5) of the scarf 12.

Access to the compartment 20 is made through an opening, such as the elongate slot-shaped opening 22. In most instances, the opening 22 will include a closure such as the zipper 24 for keeping the opening closed when the panel 14 is stowed therein. Many other types of closures could be employed, such as hook-and-loop fasteners, snaps, hooks, ties, buttons, and the like.

The size, shape, and orientation of the opening 22 may vary. However, the elongate slot-shaped opening 22 is preferred and may be incorporated in a seam of the scarf 12 so that the opening is generally parallel to the longest dimension of the scarf 12. This allows the opening 22 to be concealed in the folds of the scarf 12 when it is draped loosely around the user's neck.

The scarf 12 has a length and a width. The length "l" of the scarf in this embodiment is the circumference of the ring formed by the scarf, best seen in FIG. 3. The width "w" is the transverse dimension, best shown in FIG. 5. In most instances, the length will be greater than the width. While dimensions may vary widely, in a most preferred form, the length of the scarf when folded flat is between about 30 inches and about 40 inches, with about 35 inches being ideal. This provides a circumference of about 70-72 inches. In the case of a rectangular scarf, the length from end to end would also be about 70-72 inches. The preferred width is between about 10 and about 20 inches, and most preferably is about 14 inches. Thus, in most cases, the length will be about 2-3 times the width.

Figure 4:
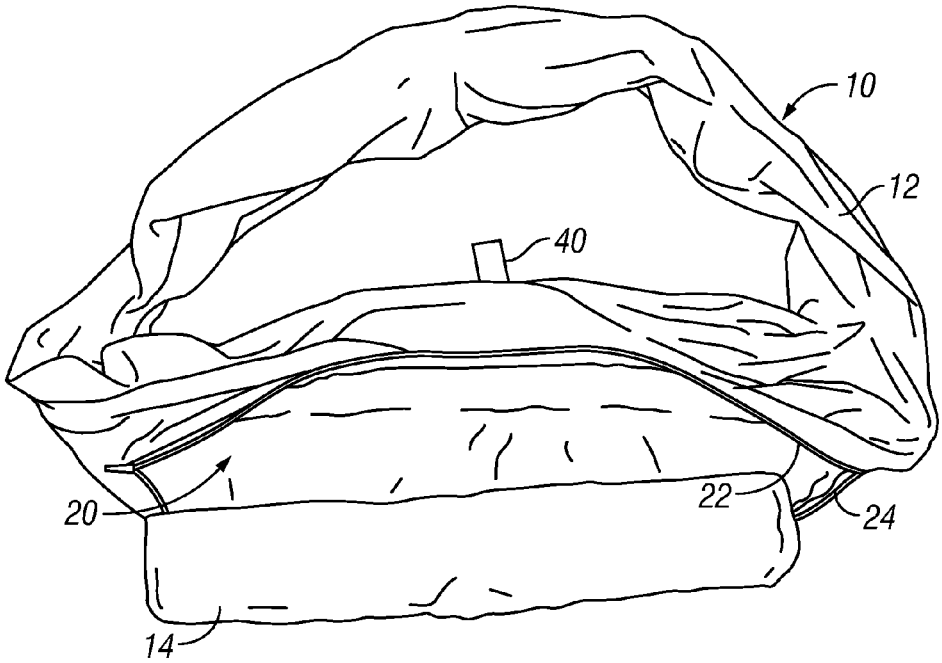
FIG. 4 is a perspective view of the scarf with the zippered compartment open and the nursing panel still in a non-deployed position.
Figure 5:
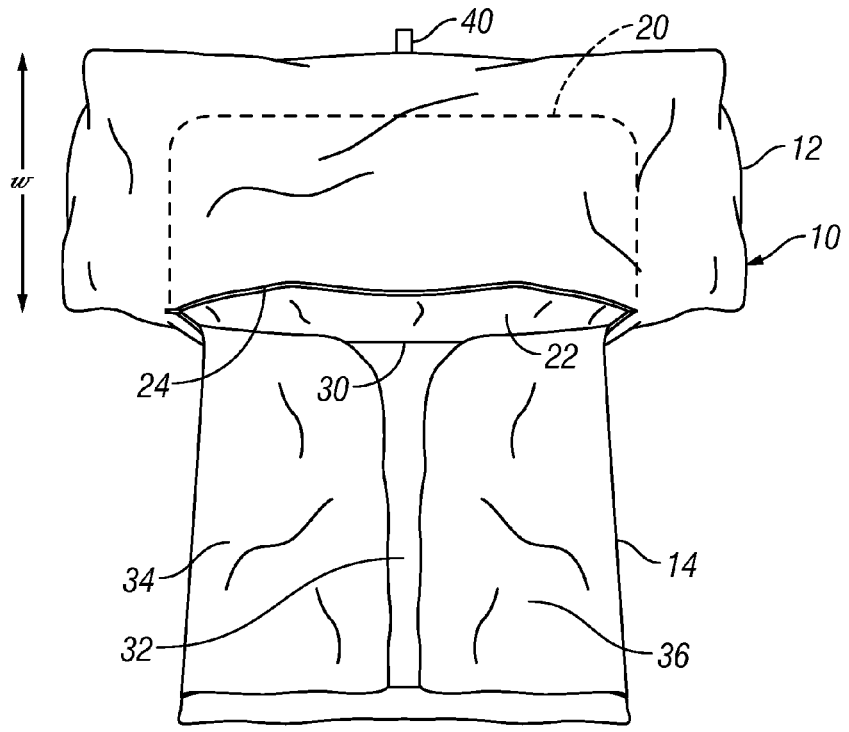
FIG. 5 shows the scarf folded in half flat and showing the nursing cover panel completely unrolled but still folded in on itself.
Figure 6:
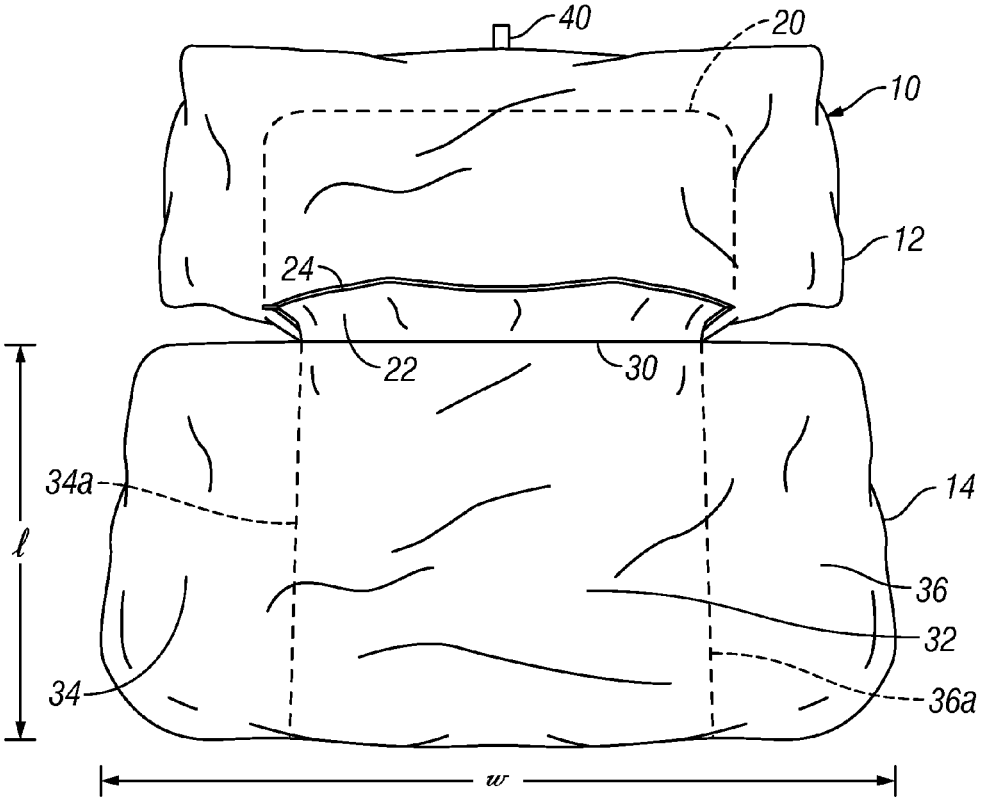
FIG. 6 shows the nursing cover panel completely unfurled with the side flaps completely open.

Referring still to FIGS. 3-6, the nursing panel 14 also preferably is made of an attractive fabric, which may match the fabric of the scarf 12 or contrast or coordinate with it. The panel 14 is sized so that when it is deployed it will cover the front of the upper torso of the person using the garment 10 as well as at least the head and shoulders of the infant when nursing. More preferably, the panel 14 is more generously sized so that when deployed it will drape entirely over the infant. This provides privacy for the mother and a sense of coziness and warmth for the infant. It also decreases the likelihood that the infant will be disturbed by the surroundings. By way of example only, a preferred size for the panel is a length "l" (FIG. 6) of between about 20 and about 25 inches and a width "w" (FIG. 6) of between about 30 and about 40 inches. The panel 14 of the illustrated embodiment, seen best in FIG. 6, is about 36 inches wide and about 22 inches long.

As best shown in FIGS. 5 and 6, the panel 14 has a proximal edge 30 that is fixed to the scarf 12 inside the compartment 20 in some suitable fashion. For example, the edge 30 may be stitched under the zipper 24 along the edge of the opening 22. In this way, the nursing panel 14 is alternately positionable between a stowed position and a deployed position. In the stowed position, shown in FIG. 3, the panel 14 is compacted inside the compartment 20, and in the deployed position, as seen in FIG. 6, the panel is unfurled. As used herein, "compacted" means folded or rolled until it will fit easily inside the compartment.

In a most preferred design, the panel 14 is formed generally of a center section 32 with two side sections 34 and 36 indicated by the vertical dashed lines 34*a* and 36*a* in FIG. 6. The side sections 34 and 36 each extend a distance beyond the proximal edge 30. That is, only the top of the center section 32 is attached to the compartment; the top of each of the side sections is free in order to facilitate folding of the panel. This is illustrated in FIGS. 5 and 6. In FIG. 5, the side sections 34 and 36 are folded in over the center section 32. When the side sections 34 and 36 are opened out, as shown in FIG. 6, the panel is fully deployed. From the folded position shown in FIG. 5, the panel 14 can be folded or rolled up, as shown in FIG. 4, in order to fit it into the compartment 20.

Returning to FIG. 1, when the garment 10 is worn as a fashion scarf, with the panel 14 stowed inside the compartment 20 in the scarf 12, the zippered opening 20 is virtually hidden in the folds of the garment. It may be desirable to include a marker on the garment 10 for indicating the location of the compartment. In the present embodiment, the tag 40 serves as such a marker. The tag 40 may be merely decorative or it may bear indicia of the manufacturer.

Those skilled in the art will readily appreciate that there are several different methods for making the inventive garment. One simple technique is to serge together the ends of a long rectangular piece of fabric to form an endless ring, and then folded circumferentially to form a tube. A zipper or other closure is sewn in at the designated location to provide the opening to the inside of the garment. As indicated, many different types of fabric may be used. For example, a soft wool or flannel may be used for colder climates during the winter. For warmer climates and seasons, a lightweight gauzy fabric may be preferred. The compartment may be formed of one or more panels of fabric sewn together and then sewn into the inner seam of the scarf.

The garment 10 may be worn and used in several different configurations for nursing an infant. As shown in FIG. 2, the panel 14 may be deployed while the scarf 12 is worn in a simple double loop style. The user ensures proper positioning of the stowed panel by positioning the tag 40 at the front. In this position, the panel 14 is unfurled easily into the deployed position shown in FIG. 2.

Figure 7:
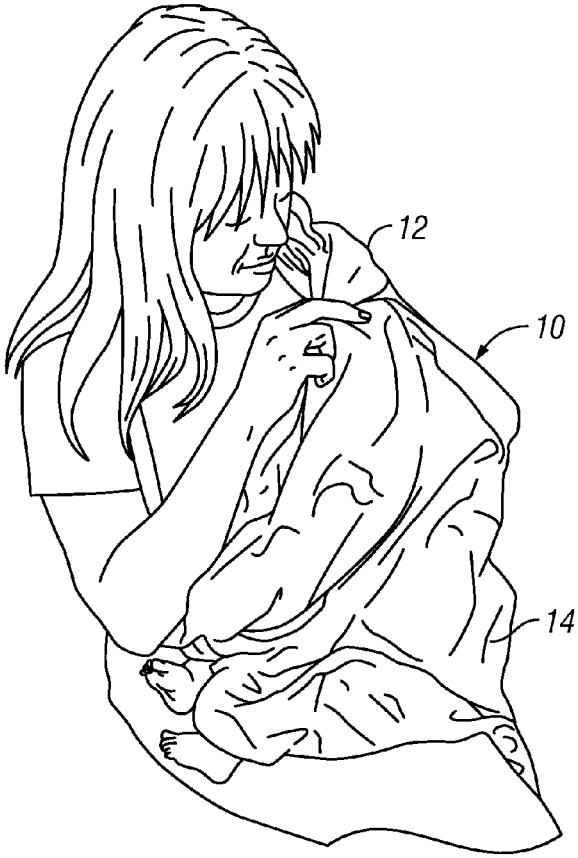
FIG. 7 is a perspective view of the woman nursing an infant showing the scarf worn in a single loop around her neck. The nursing cover panel is deployed and draped over the baby.

FIG. 7 illustrates another mode of use. The scarf 12 is draped, in a single loop, around the user's neck. This allows the panel 14 to fall further down on the user's lap and fully envelope the infant. This configuration is particularly advantageous when the user is nursing an older infant or young toddler, as many mothers are opting to nurse for up to two years. Nursing mothers will readily appreciate that older infants and young toddlers are more active as they nurse, often pulling on mother's hair and earrings and generally having very busy little hands.

Figure 8:
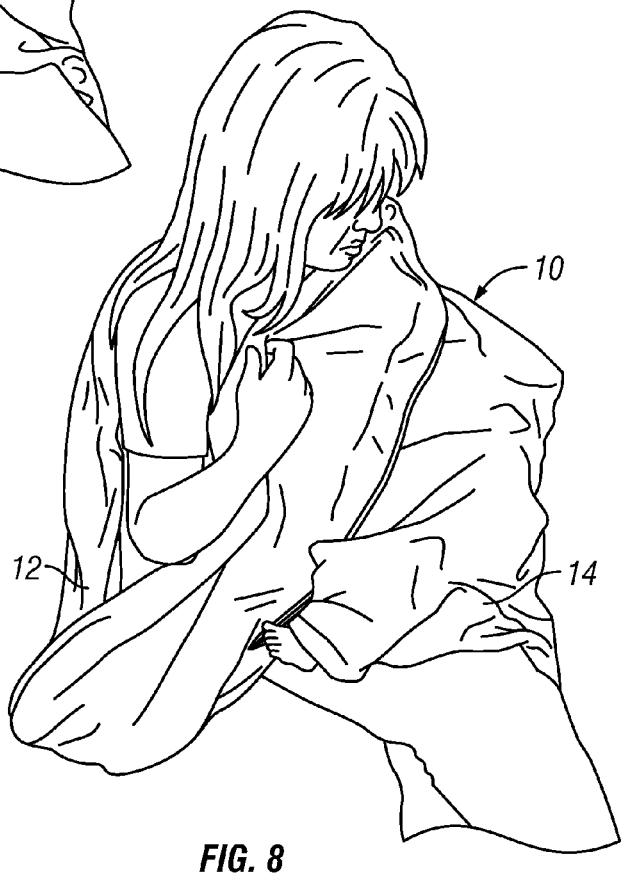
FIG. 8 is a perspective view of the woman nursing an infant showing the scarf worn in the single loop over one shoulder and under the opposite arm. The nursing cover panel is deployed and draped over the baby.

In FIG. 8, the garment 10 is worn over one shoulder and under the opposite arm in a sling-like fashion. This also allows the panel 14 to fall further down on the user's lap and fully cover the infant. Additionally, some users may be more comfortable with their free arm lying over the scarf instead of under it. Still further, the abundantly sized cover panel can also serve as a security blanket for the infant.

Figure 9:
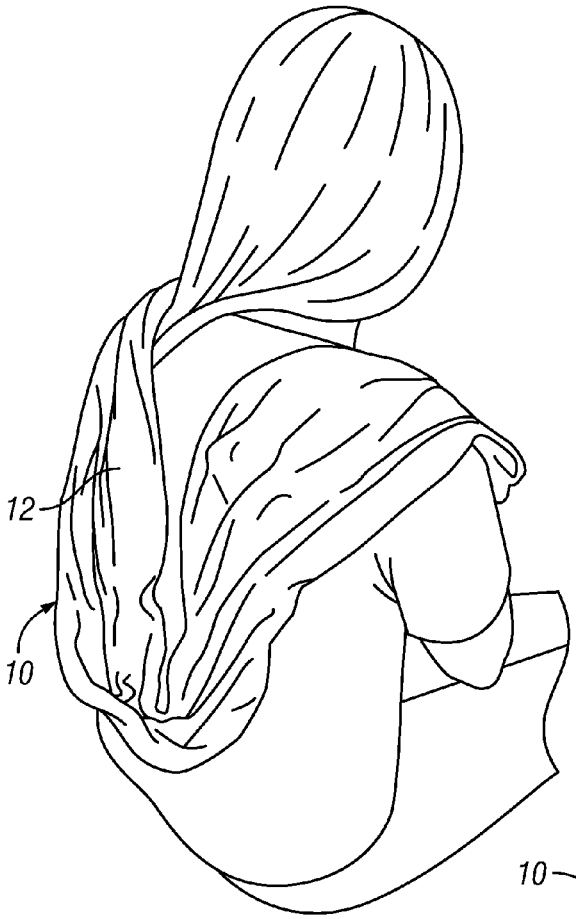
FIG. 9 is a rear perspective view of the woman nursing an infant showing the scarf worn in a single loop around the neck. The scarf is draped low in the back so it can be held in place when the woman leans back against a chair or other vertical surface.

Yet another mode of use is shown in FIG. 9. Especially with older infants, the infant may tug and wiggle and can displace unanchored covers. Sometimes, when nursing outdoors, wind can blow the nursing cover out of place. In the mode of FIG. 9, the scarf 12 is arranged in a single loop around the user's neck with the compartment 20 positioned over the user's front torso and the opposite portion of the scarf hanging down her back. With the garment 10 arranged in this way, the user can hold the scarf in position by leaning back against a chair back or other vertical surface while nursing. With the back of the scarf 12 secured in this manner, the panel 14 cannot be displaced inadvertently.

Figure 10:
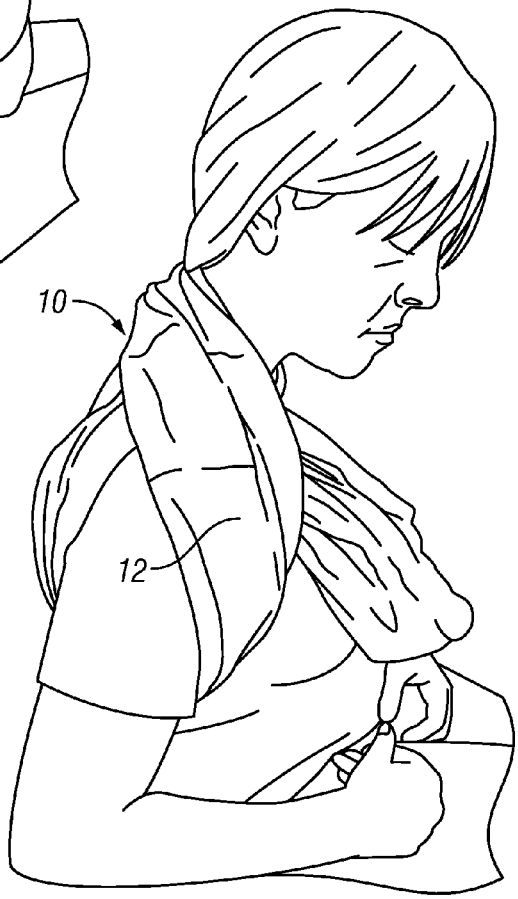
FIG. 10 is a perspective view of the scarf twisted in a figure eight with one loop around the woman's right shoulder and the other loop around her neck.

Another configuration for the garment 10 is shown in FIG. 10. In this arrangement, the scarf 12 is twisted into a figure eight shape. One loop is placed around the user's neck and the other loop is placed around one shoulder. As in other configurations, the scarf 12 is arranged so that the compartment 20 is positioned over the front torso of the user. The shoulder loop helps keep the scarf in position as the infant nurses.

Figure 11:
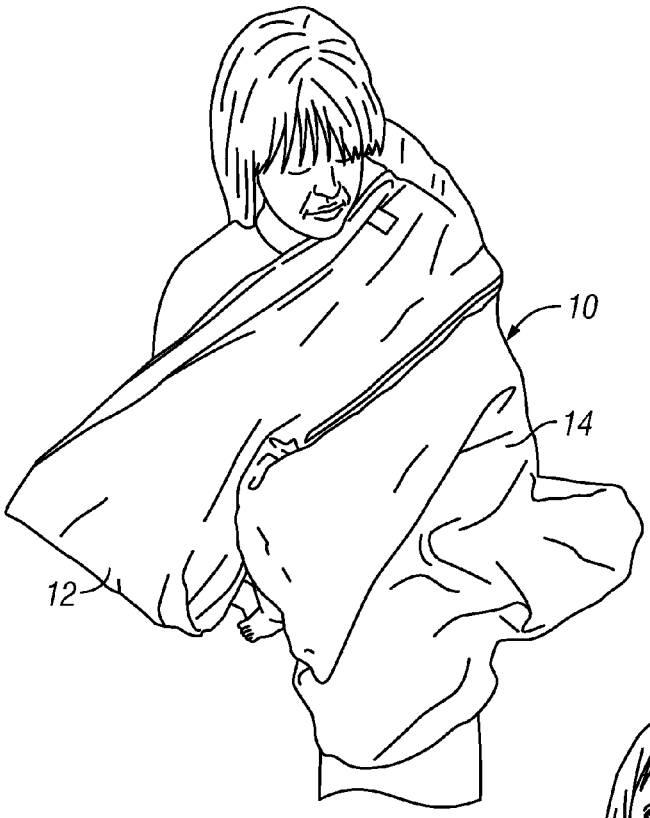
FIG. 11 is a perspective view of the woman nursing an infant showing the scarf laid out flat across the woman's torso. The nursing cover panel is deployed and draped over the baby.

In some cases, the user may prefer to remove the garment 10 entirely and spread the folded scarf 12 across her chest while the panel 14 is unfurled across her lap and over the infant. This mode of use is illustrated in FIG. 11.

Figure 12:
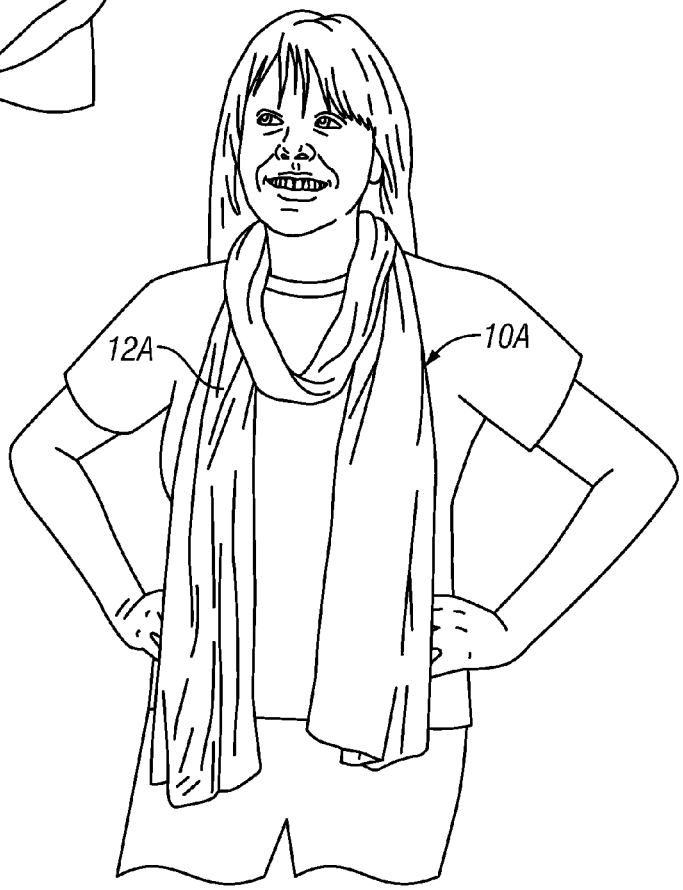
FIG. 12 is a perspective view of the woman wearing a scarf made in accordance with a second embodiment of the present invention. In this embodiment, the scarf is an elongated panel of fabric but contains the same compartment for containing the hidden nursing cover panel.

A second embodiment of the garment of the present invention is shown in FIG. 12 and designated generally as 10A. In this embodiment, the scarf 12A takes the form of a long rectangle. In this embodiment, the hidden compartment (not shown) is generally centered along the length of the scarf 12A. A preferred configuration for this scarf 12A is a single loop around the neck with both ends of the scarf hanging in front. In this configuration, the panel (not shown) can be deployed easily by opening the compartment. Alternately, when nursing, the ends could be secured behind the user's back, in a manner similar to that described in reference to FIG. 9. Various other configurations will be apparent.

Having described the preferred structure of the inventive garment, its use now will be explained. In accordance with the method of the present invention, the previously described breast feeding garment is used to nurse an infant. The user dons the garment in the desired configuration and nurses the infant while wearing the scarf with the nursing panel in the deployed position over the infant. Prior to and after nursing the infant, the user can wear the scarf as a fashion accessory with the panel in the stowed position. When it is time to nurse the infant, the user simply opens the compartment and unfurls the panel. When the infant has finished nursing, the panel is folded, rolled, or otherwise compacted and returned to the hidden compartment. Once the compartment is closed, the scarf again becomes a fashion accessory.

The embodiments shown and described above are exemplary. Many details are often found in the art and, therefore, many such details are neither shown nor described herein. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. A breast feeding garment to be worn by a person nursing an infant, wherein the person has a front, the garment comprising:

a fabric neck scarf having a length and a width, the length being greater than the width, the scarf comprising an internal compartment;

a fabric nursing panel sized to cover the front of the person and at least the infant's head and shoulders while the infant is nursing, wherein the nursing panel has a proximal edge fixed to the scarf inside the compartment, and wherein the nursing panel is alternately positionable between a stowed positioned in which the panel is compacted inside the compartment and a deployed nursing position in which the panel is unfurled.

2. The garment of claim 1 wherein the fabric neck scarf is formed as an endless ring.

3. The garment of claim 2 wherein the compartment has a location and wherein the scarf further comprises a marker indicating the location of the compartment.

4. The garment of claim 3 wherein the compartment comprises a slot-shaped opening and means for keeping the opening closed when the nursing panel is in the stowed position.

5. The garment of claim 4 wherein the means for keeping the compartment opening closed is a zipper.

6. The garment of claim 1 wherein the fabric neck scarf is rectangular.

7. The garment of claim 6 wherein the compartment is centered lengthwise in the scarf.

8. The garment of claim 1 wherein the compartment comprises a slot-shaped opening and means for keeping the opening closed when the nursing panel is in the stowed position.

9. The garment of claim 8 wherein the scarf has a longest dimension and the slot-shaped opening has a longest dimension that is parallel to the longest dimension of the scarf.

10. The garment of claim 1 wherein the nursing panel is sized to completely cover the infant's body while the infant is nursing.

11. A method for nursing an infant by a person having a front, the method comprising:

donning a breast feeding garment, wherein the garment comprises:

a fabric neck scarf having a length and a width, the length being greater than the width, the scarf comprising an internal compartment;

a fabric nursing panel sized to cover the front of the person and at least the infant's head and shoulders while the infant is nursing, wherein the nursing panel has a proximal edge fixed to the scarf inside the compartment, and wherein the nursing panel is alternately positionable between a stowed positioned in which the panel is compacted inside the compartment and a deployed nursing position in which the panel is unfurled;

nursing the infant while wearing the scarf with the fabric nursing panel in the deployed nursing position over the infant.

12. The method of claim 11 wherein the scarf is formed as an endless ring and wherein donning the garment includes arranging the scarf in a double loop configuration with the compartment positioned over the user's front torso.

13. The method of claim 11 wherein the scarf is formed as an endless ring and wherein donning the garment includes arranging the scarf in a single loop configuration with the compartment positioned over the user's front torso.

14. The method of claim 11 wherein the scarf is formed as an endless ring and wherein donning the garment includes arranging the scarf in a single loop configuration with the compartment positioned over the user's front torso and positioning the portion of the scarf opposite the compartment behind the user's back, and wherein the method further comprises seating the user in a seat with an upright back and leaning the user back against the seat back whereby the portion of the scarf on the user's back is secured while the infant is nursing.

15. The method of claim 11 wherein the scarf is formed as an endless ring and wherein donning the garment includes arranging the scarf in a figure eight and placing one loop of the figure eight around one of the user's shoulder and the other loop around the user's neck with the compartment positioned over the user's front torso while the infant is nursing.

16. The method of claim 11 wherein the scarf is formed as an endless ring and wherein donning the garment includes arranging the scarf in a single loop configuration with the compartment positioned over the user's front torso and positioning part of the scarf over one of the user's shoulder and the opposite part of the scarf under the user's opposite arm while the infant is nursing.

17. The method of claim 11 further comprising, prior to the step of nursing the infant, wearing the scarf with the nursing panel in the stowed position.

18. The method of claim 17 further comprising, after wearing the scarf with the nursing panel in the stowed position and prior to the step of nursing the infant, opening the compartment and unfurling the nursing panel over the user's front torso and the infant.

19. The method of claim 18 further comprising, after nursing the infant, compacting the nursing panel, returning the nursing panel to its stowed position inside the compartment, and closing the compartment.

20. The method of claim 11 wherein the scarf is formed as an elongate rectangle, wherein the compartment is centered along the length of the scarf, and wherein donning the garment comprises looping the scarf around the user's neck with the compartment position over the user's front torso.

21. The method of claim 20 further comprising, prior to the step of nursing the infant, wearing the scarf with the nursing panel in the stowed position.

22. The method of claim 21 further comprising, after wearing the scarf with the nursing panel in the stowed position and prior to the step of nursing the infant, opening the compartment and unfurling the nursing panel over the user's front torso and the infant.

23. The method of claim 22 further comprising, after nursing the infant, compacting the nursing panel, returning the nursing panel to its stowed position inside the compartment, and closing the compartment.

* * * * *